US005267430A

United States Patent [19]

Payen

[11] Patent Number: 5,267,430

[45] Date of Patent: Dec. 7, 1993

[54] APPARATUS FOR THE CONTINUOUS PRODUCTION OF AN ELASTANE-BASED ELASTIC YARN

[75] Inventor: Pierre Payen, Le Loup, 01320 Chalamont, France

[73] Assignees: L. Payen et cie; Pierre Payen, France

[21] Appl. No.: 844,761

[22] Filed: Mar. 2, 1992

Related U.S. Application Data

[60] Division of Ser. No. 758,350, Sep. 9, 1991, Pat. No. 5,154,044, which is a continuation of Ser. No. 547,764, Jul. 3, 1990, abandoned.

[30] Foreign Application Priority Data

Jul. 21, 1990 [FR] France ..... 89 10113

[51] Int. Cl.[5] ..... D02G 3/00; D02G 3/32

[52] U.S. Cl. ..... 57/58.32; 57/6; 57/282

[58] Field of Search ..... 57/6, 58.3, 58.32, 58.34, 57/58.36, 58.38, 282, 309, 310

[56] References Cited

U.S. PATENT DOCUMENTS

| | | | |
|---|---|---|---|
| 3,540,204 | 11/1970 | Tanaka et al. | 57/6 |
| 3,771,307 | 11/1973 | Petrille | 57/157 TS |
| 3,775,961 | 12/1973 | Womer | 57/310 |
| 3,844,103 | 10/1974 | Sasaki et al. | 57/6 X |
| 3,914,930 | 10/1975 | Jenkins | 57/207 X |
| 3,921,382 | 11/1975 | Tsujita et al. | 57/205 X |
| 3,983,687 | 10/1976 | Lewis | 57/309 X |
| 4,215,529 | 8/1980 | Gerbracht | 57/297 X |
| 4,215,530 | 8/1980 | Beau et al. | 57/282 X |
| 4,334,401 | 6/1982 | Bahia | 57/6 |
| 4,606,181 | 8/1986 | Lappage et al. | 57/58.3 X |
| 4,848,075 | 7/1989 | Frentzel-Beyme | 57/58.3 X |
| 4,945,720 | 8/1990 | Neyraud | 57/58.3 X |
| 5,154,044 | 10/1992 | Payen | 57/58.32 |

FOREIGN PATENT DOCUMENTS

| | | | |
|---|---|---|---|
| 200773 | 1/1956 | Australia | 57/58.3 |
| 644248 | 7/1962 | Canada | 57/58.3 |
| 2184230 | 11/1973 | France | 57/6 |

*Primary Examiner*—Daniel P. Stodola
*Assistant Examiner*—William Stryjewski
*Attorney, Agent, or Firm*—Wall and Roehrig

[57] ABSTRACT

An apparatus for continuous production of a covered elastane-based yarn in which a partially stretched multi-filament yarn is twisted about a tensioned bare elastane yarn, at less than 500 revolutions per meter, and then heated and stretched again to complete the residual stretching of both parts of the covered yarn.

3 Claims, 1 Drawing Sheet

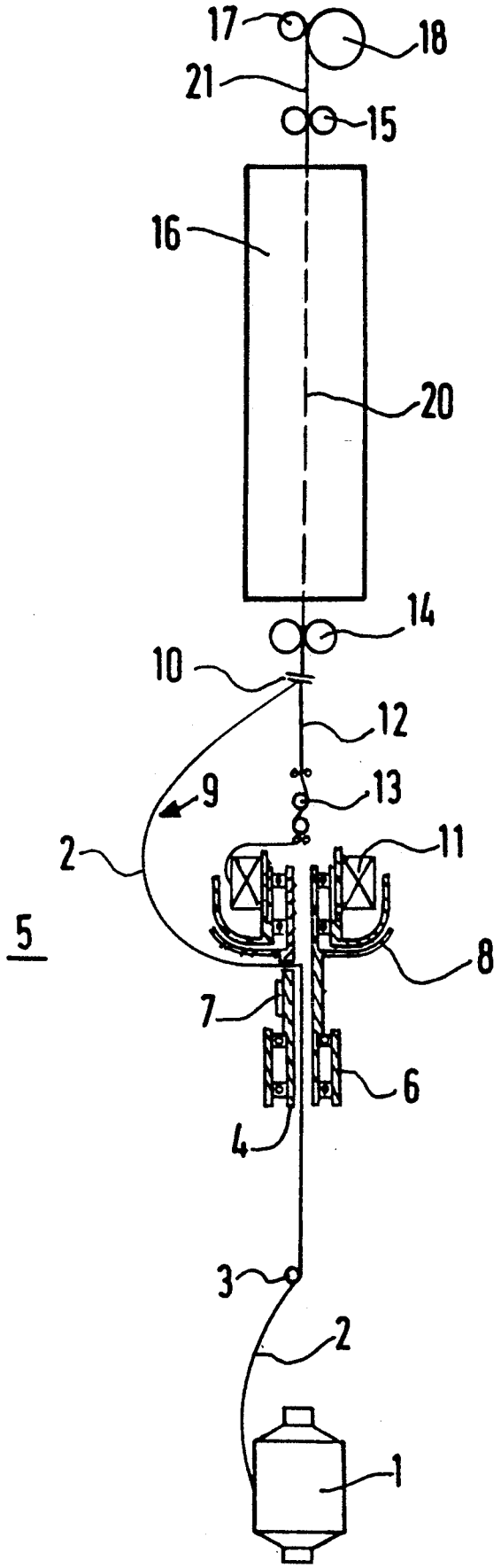
17
18
21
15
16
20
14
10
12
9
13
2
11
5
8
7
6
4
3
2
1

APPARATUS FOR THE CONTINUOUS PRODUCTION OF AN ELASTANE-BASED ELASTIC YARN

This is a division of application Ser. No. 07/758,350, filed Sep. 9, 1991, now U.S. Pat. No. 5,154,044 which is a continuation of application Ser. No. 07/547,764, filed Jul. 3, 1990 now abandoned.

The invention relates to a process for the continuous production of an elastane-based elastic yarn. It also relates to a machine for carrying out this process.

BACKGROUND OF THE INVENTION

It has been known for a very long time to produce covered elastic yarns, particularly by the so-called "single-covering" technique. For this purpose, the elastane yarn is first stretched by three to five times, and then a so-called "covering" yarn, especially a textured yarn, is wound round this in preferably contiguous coils. In practice, the covering twist, which varies as an inverse function of the count of the covering yarn, is of the order of one thousand to three thousand revolutions per meter, since it is desirable to obtain substantially contiguous coils. Thus, when the finest possible single-covered yarns with a minimum of swelling are to be produced, for instance the yarns required for the production of stocking legs, it is customary to use elastane yarns which are relatively fine, that is to say of the order of ten to forty decitex hereinafter dtex, and which are covered with a synthetic yarn, raw or textured by false twist, of ten to thirty dtex, covered at twists of the order of one thousand five hundred revolutions per meter. Although this technique is in very widespread use, it nevertheless has some appreciable disadvantages, such as the high cost price and the impossibility or difficulty of obtaining windings without a knot of considerable weight.

The Document FR-B-2,561,676 of the Applicants provided a technique which involves covering the tensioned elastane yarn with a partially stretched multifilament synthetic yarn at a covering twist of one third of the usual twist, then, in a separate phase, completing this twist by means of a double-twist spindle, and finally, in a likewise separate third phase, subjecting the covered yarn to additional residual hot stretching. This technique gives covered yarns suitable for the production of stockings and tights for which the finest possible yarns are sought. However, to obtain a correct covering of the elastane yarn and thereby protect it against unravelling, the yarn has to be twisted at twists of the order of two thousand revolutions per meter. The result is that this technique, although well developed, still remains costly.

It has also been proposed to knit or weave bare tensioned elastane yarns. This technique, although available for a long time, has not undergone further development because of the excessively high production cost resulting particularly from the high percentage of finished products such as panties of second quality.

SUMMARY OF THE INVENTION

The invention overcomes these disadvantages. It is concerned with a process and a machine for the continuous production of a single covered elastane yarn at a single work station, which is rapid and economical and which makes it possible to lower the quantity of elastane yarns and therefore the price of this yarn considerably, whilst at the same time increasing the fineness of the yarns so produced, this fineness being increasingly sought after, especially in the production of stockings and tights. Moreover, this improved technique makes it possible to use yarns so produced at knitting speeds incomparably higher than that employed with bare yarns.

This improved process for the production of an elastic yarn is characterized in that it involves continuously and at the same work station:

- in a first step, single covering, at a twist of below five hundred revolutions per meter, without a twist resultant, a tensioned bare elastane yarn with a partially stretched multifilament synthetic yarn;
- then, in a second step, subjecting this single covered yarn to additional hot stretching to complete the residual stretching of the partially stretched multifilament yarn, on the one hand, and of the tensioned elastane yarn, on the other hand;
- and finally, winding up the elastic yarn obtained.

As is known, a "partially stretched multifilament synthetic yarn" is a synthetic yarn which has undergone only partial stretching, that is to say only a partial molecular orientation. Such yarns are well known and are commonly called "POY", pre-oriented yarn or sometimes MOY (medium-oriented yarn). Such yarns are described particularly in the document FR-A-2,151,896 or in its corresponding American documents U.S. Pat. Nos. 3,771,307 and 3,772,872 of E. I. DUPONT DE NEMOURS.

A yarn "without any twist resultant" denotes a single covered yarn, each yarn of which would have a zero twist if the other yarn were removed.

In practice:

- the single covering yarn is a partially stretched polyamide yarn having a residual stretching ratio of the order of 10 to 25%;
- the elastane yarn is stretched in a ratio of three.

It is important that the single covering twist of the first step be below five hundred revolutions per meter. In fact, if covering is carried out at higher twists, on the one hand the cost price is needlessly increased without any proportional improvement, and on the other hand, above all, the appearance of the finished products such as panties is affected. Advantageously, this twist for fine yarns intended for the production of stockings and panties, that is to say those in which an elastane yarn of the order of twenty dtex is used, must be between one hundred fifty and three hundred revolutions per meter, advantageously in the neighborhood of two hundred fifty revolutions per meter.

The invention also relates to a machine for the production of such an elastic yarn. This machine, consisting of a plurality of work stations, is characterized in that each station comprises:

- a hollow spindle having a rotating plate and intended for receiving a stationary package of elastane yarn immobilized during the rotation of the plate;
- a means for feeding a partially stretched multifilament yarn from a package to the rotating plate of the hollow spindle;
- a means for stretching the elastane yarn;
- a means for single covering the partially stretched multifilament yarn with the tensioned elastane yarn without any twist resultant;
- a drawing means for stretching the covered yarn formed, to complete the residual stretching of the multifilament yarn and of the tensioned elastane yarn, consisting of two pairs of respective feed and stretching rollers;

a heating member arranged between the two pairs of rollers;

a member for winding up the elastic yarn formed.

It is essential that the stretching of the single covered yarn should be carried out hot, in order both to assist the residual stretching of the multifilament yarn and also to increase the elongation capacity of the elastane core yarn.

The document FR-A-2,184,230 of one of the Applicants describes a process for the single covering of a tensioned elastane yarn by winding a coating yarn helically at the moment of locking of the false twist, particularly with the use of a hollow spindle having a rotating plate, on which the elastane package is immobilized, and then thermal treatment, if appropriate continuously. Here, a standard, that is to say fully stretched multifilament yarn is used, and the covered yarn obtained has a poor covering by the covering yarn. This is why this technique has not in fact been developed further.

It was not obvious to bring together and then adapt the teachings of these two techniques described in the documents mentioned above, this being proved by the long period of time which has elapsed, given that because the first technique, not utilized, was concerned with a continuous process, whereas the second, utilized, was aimed at a discontinuous process. Furthermore, above all, bringing these two techniques together, but at the same time adapting them, makes it possible to deal successfully with a problem which had been posed for a very long time, namely obtaining the finest possible single covered elastic yarn capable of being knitted at high speed. Moreover, surprisingly, the invention makes it possible, for the same result, that is to say for the same textile qualities, to reduce the quantity of elastane yarn and therefore the effect of this expensive raw material on the cost price of the finished yarn. Thus, yarns produced according to the invention can be used successfully in the production of panties or stockings for which the highest fineness is sought.

BRIEF DESCRIPTION OF THE DRAWINGS

How the invention can be put into practice and the advantages arising from it will emerge more clearly from the following illustrative embodiment, in the light of the accompanying single FIGURE showing a characteristic work station according to the invention.

DESCRIPTION OF A PREFERRED EMBODIMENTS

Unwound from a spinning bobbin 1 is a 6.6 POY, pre-oriented yarn, polyamide yarn 2 having a count of seventeen dtex and formed from six parallel elementary filaments. After additional stretching, this POY yarn 2 makes it possible to obtain a standard six-strand fourteen dtex yarn.

This coating yarn 2 subsequently passes through a tension device 3 and then enters the hollow axle 4 of a hollow spindle, designated by the general reference 5, which is carried by a bearing 6 and which is driven tangentially by a belt 7. In a known way, the bearing 6 can be disengaged by moving the belt 7 away. The partially stretched single covering yarn 2 passes through the axle of the spindle 4, enters the rotating plate 8 tangentially and forms a balloon 9 limited by the balloon stop lappet 10.

The spindle 5 carries a package 11 of elastane yarn 12, for example a yarn marketed by E. I. DUPONT DE NEMOURS under the registered trademark LYCRA, of twenty-two dtex either monofilament or multifilament. During the rotation of the rotating plate 8, this package 11 is stationary. The elastane yarn 12 is highly tensioned as result of the braking which the tension device exerts on it, whilst it is drawn upwards by the positive feed of the first feed roller 14 of the drawing means. The elastane yarn 12 thus elongated enters the lappet 10, where it is wrapped with the yarn 2, with a false-twist effect, but without any twist resultant. The wrapped yarn 20 obtained subsequently enters a drawing means formed by two pairs of respective feed 14 and stretching 15 rollers or capstans, in order to undergo an additional stretching intended for completing the residual stretching of the partially stretched multifilament yarn 2, on the one hand, and of the tensioned elastane yarn 12, on the other hand.

To make it easier to obtain this stretching and the elongation properties of the finished yarn, this additional characteristic stretching is carried out hot, that is to say by passage through a known thermal heater 16.

The finished wrapped elastic yarn 21 is wound up by a known means 17 in the form of a reel 18. In a practical embodiment, the covering yarn 2 is a 6.6 seventeen dtex six-strand polyamide POY yarn which, after stretching, is capable of forming a standard fourteen dtex six-strand yarn. The elastane core yarn 12 is a LYCRA yarn, registered trademark of E. I. DUPONT DE NEMOURS, of twenty-two dtex which, after passing through the tension device 13, is stretched by approximately three times in order to be brought to seven dtex. The speed ratio between the two capstans 14 and 15 is set at approximately 20% and the temperature of the heater 16 at 160° C.

There is thus obtained a single covered elastic yarn 21 consisting of a substantially rectilinear elastane yarn of approximately six dtex, covered uniformly, but not contiguously with turns of 6.6 fourteen dtex six-filaments polyamide. The final count of this yarn 21 is twenty dtex, this hitherto being very difficult to obtain economically. This yarn is perfectly suitable for the production of stockings and panties on high-speed knitting machines.

I claim:

1. Apparatus for a continuous production of a covered elastomeric yarn that includes:

a hollow rotatable spindle means having a first supply means mounted for rotation thereon for feeding an elastane core yarn along a path of travel onto a take-up means, said spindle means further having a radially disposed opening therein and a radial disposed guide plate adjacent to said opening, drive means for rotating said spindle means at a predetermined speed, a second supply means for feeding a pre-oriented cover yarn through said opening in said spindle means whereby the cover yarn is directed by said guide plate into a balloon, tensioning means for tensioning the cover yarn prior to its entering said spindle means, wrapping means for wrapping said ballooned cover yarn about the core yarn as said core yarn moves along said path of travel, stretching means for partially stretching the core yarn prior to its entering the wrapping means, heating means positioned between the wrapping means and the take-up means for raising the temperature of the wrapped core yarn to a desired level, and drawing means for acting upon the wrapped core yarn as it passes through the heating means to complete residual stretching of the wrapped core yarn.

2. The apparatus of claim 1 wherein said drawing means includes two spaced apart sets of drive rollers for engaging the wrapped core yarn therebetween and means for drawing one set of an upstream drive rollers at a speed that is less than that of a downstream set of drive rollers.

3. The apparatus of claim 2 wherein said wrapping means is a lappet for producing a false twist of the cover yarn about the core yarn.

* * * * *